United States Patent [19]

Hiramatsu et al.

[11] 4,349,523

[45] Sep. 14, 1982

[54] PROCESS FOR PRODUCING CARBON FIBER OF IMPROVED OXIDATION RESISTANCE

[75] Inventors: Toru Hiramatsu; Teruo Koseki, both of Ehime; Satosi Hamada, Matsuyama; Atsushi Sumida, Ehime, all of Japan

[73] Assignee: Toray Industries, Inc., Tokyo, Japan

[21] Appl. No.: 229,747

[22] Filed: Jan. 29, 1981

Related U.S. Application Data

[63] Continuation of Ser. No. 83,801, Oct. 11, 1979, abandoned, which is a continuation-in-part of Ser. No. 893,683, Apr. 5, 1978, abandoned.

[30] Foreign Application Priority Data

Apr. 5, 1977 [JP] Japan ..... 52-38142

[51] Int. Cl.[3] ..... D01F 9/22

[52] U.S. Cl. ..... 423/447.4; 264/29.2; 423/447.2; 423/447.6

[58] Field of Search ..... 423/447.4, 447.1, 447.6, 423/447.7, 447.8; 264/29.2, 182

[56] References Cited

U.S. PATENT DOCUMENTS

| | | | |
|---|---|---|---|
| 3,993,719 | 11/1976 | Matsumura et al. | 423/447.1 |
| 4,001,382 | 1/1977 | Matsumura et al. | 423/447.1 |
| 4,024,227 | 5/1977 | Kishimoto et al. | 423/447.6 |
| 4,080,417 | 3/1978 | Kishimoto et al. | 423/447.1 |

FOREIGN PATENT DOCUMENTS

| | | | |
|---|---|---|---|
| 49-94925 | 9/1974 | Japan | 423/447.1 |

*Primary Examiner*—Edward J. Meros

*Attorney, Agent, or Firm*—Finnegan, Henderson, Farabow, Garrett and Dunner

[57] ABSTRACT

Disclosed is a carbon fiber of improved oxidation resistance, which has a specific volume resistance of at least about $1.2\times10^{-3}$ ohm cm, and containing at least about 2 wt. % of nitrogen and less than about 0.07 wt. % of total metal impurities. The carbon fiber is produced by using as the precursor fiber an acrylonitrile copolymer fiber, which copolymer is comprised of at least 95 mole % of units derived from acrylonitrile and not more than 5 mole % of units derived from a carboxyl group containing monoethylenically unsaturated monomer or monomers; the hydrogen atom of at least one —COOH contained in each of the units derived from the carboxyl group-containing monomer or monomers being replaced with a cation selected from

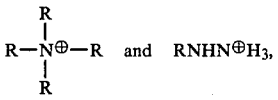

wherein R is H, (C1-3) alkyl or phenyl; the replacement being to such an extent that the units having the cation occupy at least 0.1 mole %, based on the copolymer; and which copolymer contains less than about 0.05 wt. % of the total metal impurities. All of the aqueous baths used in the course of producing the carbon fiber, i.e., aqueous coagulating, drawing, washing and oiling baths, are prepared from deionized or distilled water, and the aqueous oiling bath is prepared by using a cationic or nonionic oiling agent.

2 Claims, No Drawings

PROCESS FOR PRODUCING CARBON FIBER OF IMPROVED OXIDATION RESISTANCE

RELATED APPLICATION

This application is a continuation of application Ser. No. 083,801 filed Oct. 11, 1979 which in turn is a continuation-in-part of application Ser. No. 893,683 filed Apr. 5, 1978, both now abandoned.

BACKGROUND OF THE INVENTION (1) Field of the Invention

This invention relates to a process for producing a carbon fiber of enhanced oxidation resistance.

(2) Description of the Prior Art

In general, a carbon fiber is manufactured by a process wherein a precursor fiber such as an acrylonitrile polymer fiber, a regenerated cellulose fiber, a pitch fiber or the like is heated at a temperature of 200° to 350° in an oxidizing gas atmosphere thereby to be oxidized; then, the oxidized fiber is carbonized at a temperature of at least 700° C. in a non-oxidizing gas atmosphere. The resulting carbon fiber is depending upon the temperature at which the fiber is heated in the final step, classified into two types, i.e. a carbon fiber in a narrow sense and a graphite fiber. A carbon fiber in a narrow sense means a carbon fiber obtained by heating the oxidized fiber at a temperature of 700° C. to 1,600° C., thereby to be carbonized; and a graphite fiber means a fiber obtained by further heating the carbonized fiber at a temperature of 1,600° to 3,000° C., thereby to be graphitized. Due to the difference in heating temperature, the carbon fiber and the graphite fiber are different in their mechanical properties as well as their specific volume resistance and nitrogen content. The graphite fiber usually exhibits a larger modulus of elasticity, a smaller tensile strength and worse adhesive properties for composite matrixes such as resins and carbon, than those of the carbon fiber.

An illustration of graphitization of carbon fibers is given in U.S. Pat. No. 4,001,382. It is stated in column 4, lines 28 through 31 of this patent that carbon fibers are heated generally to a temperature of 2,000° C. to 3,500° C. in order to graphitize the carbon fibers. By graphitization conducted at such a high temperature, most of the impurities contained inside the carbon fibers are expelled therefrom, and thus, the resultant graphite fibers exhibit enhanced oxidation resistance. However, the graphite fibers are very costly and, as mentioned above, poor in tensile strength and adhesive properties for composite matrixes. Thus, the graphite fibers have only limited applications.

With respect to carbon fibers, many proposals have been heretofore made in order to enhance their tensile strength and modulus of elasticity, for example, in U.S. Pat. Nos. 4,001,382; 4,024,227; 3,993,719 and 4,080,417. The main points in these proposals are as follows. (1) the step of incorporating an acrylonitrile copolymer having comonomer units possessing carboxyl groups, at least a part of which has an alkali metal or ammonium ion introduced therein, in the acrylonitrile polymer to be made to an acrylic fiber precursor; (2) the step of treating a water-swollen acrylic fiber with a aqueous solution of a primary amine or ammonium salt; (3) the step of treating a water-swollen acrylic fiber with an aqueous emulsion of aminosiloxane; or (4) the steps of drawing an acrylic fiber to a great extent and drying the drawn acrylic fiber to an extent such that the water content is less than 4% by weight.

Although tensile strength and modulus of elasticity of carbon fibers can be enhanced by the above-mentioned proposals, oxidation resistance of carbon fibers is not enhanced. It now has been found by the inventors of the present invention that oxidation resistance of carbon fibers greatly varies depending upon the amounts of the particular metal impurities contained in the carbon fibers. That is, carbon fibers containing significant amounts of Na, K, Fe, Cu, Ni, Co, Cr and Mn are poor in oxidation resistance. In the conventional techniques for the production of carbon fibers, including the above-mentioned proposals, no consideration is given for preventing or minimizing the incorporation of the specified metal impurities into the acrylonitrile polymer, the acrylic fiber precursor made therefrom, or the carbon fiber made therefrom over the entire courses spanning from the step of polymerizing acrylonitrile to the step of collecting carbonized fibers. In some cases, the acrylonitrile polymer, the acrylic fiber precursor made therefrom or the carbon fiber made therefrom may contain, in addition to the above-specified metal impurities, other metals such as Zn, Pb, Sn and Hg, and halogens and sulfur. These impurities, other than the above-specified metal impurities, reduce the adhesive properties for composite matrixes, such as resins and carbon, and exert a harmful influence upon the human body. Furthermore, waste gases, generated when acrylic fibers containing halogens and sulfur are carbonized, cause air pollution. However, the impurities, other than the above-specified metal impurities, have little or no influence upon the oxidation resistance of the carbon fibers.

It is to be noted that, in most of the conventional techniques for the production of carbon fibers, the acrylic fibers are inevitably treated with an aqueous solution which contains some of the above-specified metal impurities, and methods to prevent or minimize the incorporation of the specified metal impurities into the acrylic fibers are not considered. For example, when an acrylonitrile copolymer containing comonomer units having carboxyl groups, at least a part of which has ammonium ions introduced therein, as described in U.S. Pat. No. 4,001,382, is extruded into an aqueous coagulating bath to form a fiber, followed by treating the fiber by using an aqueous drawing bath and an aqueous washing bath, an ion exchange reaction rapidly occurs between the ammonium ions and metal impurities present in the aqueous coagulating, drawing and washing baths. This ion exchange reaction is conspicuous particularly when the aqueous coagulating bath has incorporated therein inorganic compunds, such as sodium thiocyanate and other alkali metal salts as coagulating agents. Consequently, the acrylic fiber inevitably contains an increased amount of metal impurities and a reduced amount of the ammonium carboxylate groups, and thus, the resulting carbon fiber is poor in oxidation resistance.

SUMMARY OF THE INVENTION

It is, therefore, a main object of the present invention to provide a process for producing a carbon fiber which contains only negligible amounts of metal impurities such as Na, K, Fe, Cu, Ni, Co, Cr and Mn and thus, exhibit enhanced oxidation resistance. The carbon fiber produced by the process of the present invention is characterized as having a specific volume resistance of at least about $1.2\times10^{-3}$ ohm.cm, particularly from about $1.3\times10^{-3}$ to about $2.2\times10^{-3}$ ohm.cm, and containing, based on the weight of the carbon fiber, at least about 2% by weight, particularly from about 3% to about 8% by weight, of nitrogen, and less than about 0.7% by weight, particularly less than 0.03% by weight, of total metal impurities consisting of Na, K, Fe, Cu, Ni, Co, Cr and Mn.

In accordance with the present invention, there is provided an improvement in a process for producing a carbon fiber of enhanced oxidation resistance, wherein a precursor acrylic polymer fiber is heated at a temperature of from about 200° to about 350° C. in an oxidizing atmosphere, thereby to be oxidized, and then, the oxidized fiber is heated to a temperature of from about 700° to about 1,600° C. in a non-oxidizing atmosphere, thereby to be carbonized, said improvement comprising using as the precursor fiber an acrylonitrile copolymer fiber, which copolymer is comprised of at least 95% by mole of units derived from acrylonitrile and not more than 5% by mole of units derived from a carboxyl group containing copolymerizable monoethylenically unsaturated monomer or monomers; the hydrogen atom of at least one carboxyl group contained in each of the units derived from the carboxyl group-containing monomer or monomers being replaced with a cation selected from

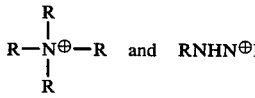

wherein R is selected from a hydrogen atom, alkyl groups having 1 to 3 carbon atoms and a phenyl group; said replacement being to such an extent that the units having the introduced cation occupy at least 0.1% by mole, based on the copolymer; and which copolymer contains below about 0.05% by weight, based on the weight of the copolymer, of total impurities consisting of Na, K, Fe, Cu, Ni, Co, Cr and Mn; and said acrylonitrile copolymer fiber being produced by the steps of:

preparing a spinning dope of the acrylonitrile copolymer in an organic solvent, and;

extruding the spinning dope into an aqueous coagulating bath to form a fiber, followed by treating the fiber by using an aqueous drawing bath, an aqueous washing bath and an aqueous oiling bath, all of the aqueous baths being prepared from water selected from deionized water and distilled water, and the aqueous oiling bath being prepared by using a cationic or nonionic oiling agent.

The carbon fiber obtained by the process of the present invention exhibits an oxidation resistance of a magnitude approximately similar to that of a graphite fiber, and also exhibits enhanced tensile strength and adhesive properties for composite matrixes as compared with those properties of a graphite fiber.

DETAILED DESCRIPTION OF THE INVENTION

The content of impurities in a fiber is determined as follows.

Determination of Na, K, Fe, Cu, Ni, Co, Cr, and Mn: A specimen fiber is heated at about 600° C. in air for a period of four hours thereby to be reduced to ashes. The ashes are dissolved in hydrochloric acid. The contents of the respective metals in the solution are determined according to atomic absorption spectroscopy by using an atomic absorption spectrophotometer of the 170-30 type supplied by HITACHI MFG. Co., Japan.

The content of nitrogen in a carbon fiber is determined by measuring the nitrogen content value by using an elementary analyzing apparatus of the CHN Corder Model MT-2 type, supplied by YANAGIMOTO Co., Japan, and making a correction for the measured nitrogen content value with reference to the moisture content in the specimen carbon fiber.

The specific volume resistance of a carbon fiber is determined as follows. The electrical resistance of a specimen carbon fiber is measured by using a multimeter, of the 3490 type, supplied by YOKOGAWA-HEWLETT PACKARD Co., wherein both ends of the specimen are sandwiched by copper plates. This measurement of electrical resistance is conducted on four specimens of different length selected from the range of 5 to 70 cm in order to remove the influence of the contact resistance of the terminals. The measured numerical values are plotted in a graph, the ordinate and abscissa of which are marked with electrical resistance in ohms and the specimen length in cm, respectively. An approximate equation of R(Resistance in ohm-)$=a\times1$ (specimen length in cm)$+b$, is obtained from the graph according to the method of least squares, and the gradient "a" (ohm/cm) of this equation is calculated therefrom. Then, an average cross-sectional area "S" ($cm^2$) of the specimens is calculated from the specific gravities determined according to the Archimedean method by using dibromobenzene. Finally, the specific volume resistance in ohm·cm is calculated from the equation: specific volume resistance$=a\times S$.

If a carbon fiber contains conspicuous amount of metal impurities, such as listed above, the carbon fiber has poor oxidation resistance and has a poor capability of being molded into a carbon fiber-carbon composite article. That is, when the carbon fiber is exposed to an elevated temperature in an oxidizing atmosphere, the weight of the carbon fiber is reduced to a considerable extent, although the extent of the weight loss varies depending upon the particular metal impurities contained therein and the amounts thereof. Among metal impurities, alkali metals, i.e. Na and K, and transition metals, i.e. Fe, Cu, Ni, Co, Mn and Cr function as oxidation accelerating catalysts, and hence, are particularly undesirable. When the carbon fiber is molded into a carbon fiber-carbon composite article, the resulting composite article has an increased volume of voids formed therein by the presence of impurities such as Cl, Br, I and S, and furthermore, the composite article is poor in adhesion between the carbon fiber and the carbon matrix, due to the fact that metal impurities such as Na and K migrate to the surface of the carbon fiber.

The carbon fiber of the present invention, which contains below about 0.07% by weight of the metal impurities based on the weight of the carbon fiber, exhibits very good oxidation resistance. For example, when the carbon fiber is maintained at 315° C. in air for a period of 300 hours, the weight loss is only below about 10% by weight. Thus, although the carbon fiber or shaped articles made therefrom are used often at an elevated temperature in an oxidizing atmosphere, the deterioration in physical properties of the fiber or the shaped articles, occurring due to the weight loss, is almost negligible. Furthermore, in the course of manufacturing a carbon fiber-carbon composite article from the carbon fiber of the present invention, when the carbon fiber is impregnated with a resin and the resin-impregnated carbon fiber is baked, only trace amounts of the metal impurities are expelled from the carbon fiber and migrate to the surface of the carbon fiber. Therefore, both the formation of voids in the carbon fiber and the reduction of adhesion between the fiber and the carbon matrix are negligible.

The content of the impurities in the carbon fiber of the present invention may be reduced to the minimum value which is capable of being determined by a conventional analyzing technique.

The above-mentioned carbon fiber of high purity is produced from the following precursor fiber. The precursor used should be an acrylonitrile copolymer which contains negligible amounts of the above mentioned metal impurities or the materials capable of being converted into such impurities. The precursor acrylonitrile copolymer fiber should possess better mechanical properties than those of conventional acrylic fibers used for wearing apparel. In other words, the precursor fiber should possess a more homogeneous and stabilized structure than acrylic fibers used for wearing apparel, i.e., should be denser and have little or no faults, such as cracks and voids, and undesirable fusion to adjacent fiber.

The process of preparing such a precursor acrylonitrile polymer fiber will be explained in detail below.

The acrylonitrile copolymer is comprised of at least 95% by mole, preferably from 98% to 99.9% by mole, of units derived from acrylonitrile and not more than 5% by mole, preferably from 0.1% to 2% by mole, of units derived from a carboxyl group containing copolymerizable monoethylenically unsaturated monomer or monomers. Such carboxyl group containing monomers include, for example, itaconic acid, acrylic acid, methacrylic acid, ethacrylic acid, crotonic acid, isocrotonic acid, maleic acid, fumaric acid, and butenetricarboxylic acid. Of these itaconic acid, acrylic acid and methacrylic acid are preferable. These carboxyl group containing monomers may be used either alone or in combination.

When the amount of the carboxyl group containing monomer is smaller than about 0.1% by mole, the resultant fiber is liable to become opaque in the spinning step and is not dense. In contrast, when the amount of the carboxyl group containing monomer is too large, the resultant fiber is usually poor in mechanical properties and tends to fuse to adjacent fibers within a fiber bundle.

In addition to the carboxyl group containing monomer or monomers, other copolymerizable monoethylenically unsaturated monomers may be used, provided that the total amount of the comonomers other than acrylonitrile is not more than 5% by weight of the copolymer. For example, for the purpose of accelerating the heat stabilization reaction, i.e. oxidation of the precursor fiber, or improving other properties of the precursor fiber, alkyl esters of the above-mentioned carboxyl group containing monomers, hydroxyalkyl acrylic compounds, acrylic amide, vinylpyridine, vinylpyrrolidone and styrene may be used.

The procedure for preparing the acrylonitrile polymer does not have to be of a specific type. Conventional polymerization procedures, for example solution, suspension and emulsion polymerization procedures, may be employed for this purpose.

However, in order to avoid the incorporation of the hereinbefore mentioned metal impurities in the polymer, a solution polymerization procedure is preferable wherein organic solvents such as dimethylsulfoxide, dimethylformamide, dimethylacetamide, ethylene carbonate and γ-butyrolacetone are used as the polymerization medium, and; N,N'-azobisisobutyronitrile, N,N'-azobisvarelonitrile and the like are used as the polymerization catalyst. The organic solvents used should not contain any metal impurities or should contain only below 0.0005% by weight of the heretofore mentioned metal impurities.

The prepared acrylonitrile polymer is treated with at least one cation of the formulae:

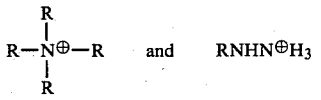

wherein each R is selected from a hydrogen atom alkyl groups having 1 to 3 carbon atoms and a phenyl group, whereby the hydrogen atom of at least one carboxyl group contained in each of the units derived from the carboxyl group containing monomer or monomers is replaced with the above mentioned cation. This treatment may conveniently be carried out by incorporating the cation forming compound such as ammonia, hydrazine or amine in a solution of the acrylonitrile copolymer in an organic solvent. Cation forming compounds, such as ammonia, hydrazine and amine, may be used either alone or in combination.

Instead of treating the acrylonitrile polymer with the cation forming compound, the cation forming compound may be incorporated in the monomer mixture before copolymerization or in the polymerization mixture during copolymerization. However, it is advantageous to treat the copolymer after the completion of copolymerization as explained above, because both control of the degree of polymerization and the polymerization operation are easy.

The amount of the cation forming compound used should be such that the units having the introduced cation occupy at least 0.1% by mole, preferably from 0.1% to 5% by mole, and more preferably from 0.1% to 2% by mole, based on the copolymer. When the amount of the cation forming compound is too small, it is difficult to obtain the intended dense fiber.

A spinning dope of the above mentioned acrylonitrile copolymer exhibits good stability and coagulating property and does not become opaque during wet spinning, and hence, it is easily spun into fibers by a conventional wet spinning procedure. However, care should be taken that the spun fiber is not contaminated with the hereinbefore mentioned metal impurities or the materials capable of being converted to such metal impurities, throughout the entire course of spinning including coagulating, drawing, washing and oil-treating steps. Purified water and chemicals should be used in the coagulating, drawing, washing and oil-treating steps. As water, deionized water or distilled water is used which has a metal content of less than about 0.0005% by weight, preferably less than about 0.0001% by weight, as measured in accordance with a decreased volume of water by using an atomic absorption spectroscope.

The spinning dope, the aqueous coagulating bath, the aqueous drawing bath and the aqueous washing bath should contain only negligible amounts, preferably not more than 0.0005% by weight, based on the weight of the respective dope or bath, of the hereinbefore mentioned metal impurities.

In the step of drawing the acrylonitrile copolymer fiber wherein the fiber is drawn usually from about six times to about fifteen times its original length in an aqueous drawing bath, it is preferable that the drawing of the fiber is conducted while the fiber is brought into contact with a stream of the aqueous drawing bath.

In the step of washing the acrylonitrile copolymer fiber with deionized or distilled water, which fiber is in a swollen gel state after the steps of coagulation and drawing, washing should be carried out to an extent sufficient for reducing the content of solvent remaining in the washed swollen gel fiber to less than about 0.01% by weight, preferably less than about 0.005% by weight, based on the weight of the dry fiber. It is preferable that the washing is conducted while the fiber is brought into contact with a stream of deionized or distilled water.

When conspicuous amounts of solvent, particularly more than about 0.03% by weight of solvent, remain in the fiber, the fibers are liable to fuse to each other upon heating in an oxidizing atmosphere, and hence, the resultant carbon fiber is poor in mechanical properties. Particularly, a sulfur-containing solvent such as dimethylsulfone, methyl thiocyanate or dimethylsulfoxide should be substantially completely removed from the fiber because the remaining solvent is converted to a sulfur impurity.

The precursor acrylic fiber should not contain any metal impurities or should contain only less than about 0.05% by weight, based on the weight of the dry fiber, of the hereinbefore mentioned metal impurities for obtaining the intended oxidation resistant carbon fiber. In order to obtain such precursor acrylic fiber which does not contain the hereinbefore mentioned metal impurities or contains only a negligible amount of these impurities, care should be taken so that all of the materials used in the course of manufacturing the precursor acrylic fiber do not contain or contain only a negligible amount of the hereinbefore mentioned metal impurities, said materials being, for example, monomers, a polymerization catalyst, a solvent and additives, which are used in the step of polymerization, and water, a solvent, and an oiling agent. Likewise, such care should be taken to the purities of the chemicals which are used in the surface treatment and sizing treatment of the carbonized fiber.

In the step of the oiling treatment, a cationic or nonionic oiling agent should preferably be used. An anionic oiling agent, which is a salt of a metal selected from Na, K, Fe, Cu, Ni, Co, Cr and Mn, should not be used. In general an aqueous oiling bath containing not more than approximately 0.1% by weight of the hereinbefore mentioned metal impurities can be used in the process of the present invention, because the amount of the oiling agent deposited onto the fiber is very minor. An oiling agent is usually used in the form of an aqueous solution or emulsion having a concentration of from approximately 0.5 to 10% by weight, and from approximately 0.5 to 5% by weight (in terms of the solid content and based on the weight of the dry fiber) of the oiling agent is deposited onto the fiber. Even if a minor amount of metal impurities is contained in an aqueous oiling bath, the ion exchange reaction occurs only to a negligible extent. This is because, first, the fiber is in a consolidated form to some extent and, secondly, the contact time of the fiber with the aqueous oiling solution or emulsion is very short, usually below about two seconds. Thus, the only consideration that must be taken into account is the pickup of the oiling agent. For example, if the aqueous oiling solution or emulsion used contains not more than 0.1% by weight of the metal impurities and the pickup of the oiling agent is 5% by weight (in terms of the solid content and based on the weight of the dry fiber), the amount of the metal impurities deposited onto the fiber is at most 0.005% by weight. This small deposited amount permits production of a carbon fiber of the intended oxidation resistance.

Suitable oiling agents include, for example amine type cationic oiling agents such as triethanolamine monostearate acetic acid salt; quaternary ammonium salt type cationic oiling agents such as stearamide methylpyridinium chloride, lauryltrimethylammonium chloride and lauryldimethylbenzylammonium chloride; polyethylene glycol type nonionic oiling agents such as nonylphenol ethylene oxide addition products, lauryl alcohol ethylene oxide addition products, oleyl alcohol ethylene oxide addition products and stearic acid ethylene oxide addition products; and polyhydric alcohol type nonionic oiling agents such as sorbitan oleic acid triester and sorbitan stearic acid monoester ethylene oxide addition products.

The oil-treated fiber in a swollen form is then subjected to drying at an elevated temperature whereby water contained therein is removed and the fiber is converted into a consolidated structure having little or no voids or cracks.

The acrylonitrile copolymer fiber obtained by the above mentioned procedure contains only less than 0.05% by weight, based on the weight of the fiber, of the heretofore mentioned impurities. The fiber is of a consolidated structure and has little or no voids or cracks. The tensile strength of the fiber is large enough for use in the production of a carbon fiber (for example, about 280 kg/mm$^2$ or more), although the tensile strength varies depending upon the spinning conditions, particularly the drawing ratio and the drying and consolidating conditions.

The acrylonitrile polymer fiber may be converted to a carbonized fiber by a conventional procedure. That is, the acrylonitrile polymer fiber is heated at a temperature of from about 200° to about 350° C. in an oxidizing atmosphere thereby to be oxidized. The oxidized fiber is then heated to a temperature of from about 700° to about 1,600° C., thereby to be carbonized. In order to produce a carbon fiber having improved oxidation resistance, which fiber is particularly useful in aeronautic and space applications, it is preferable to conduct the carbonization at a relatively high temperature of from 1,200° C. to 1,500° C. The carbon fiber carbonized at such a high temperature has a specific volume resistance of from $1.3\times10^{-3}$ to $2.2\times10^{-3}$ ohm,cm, a tensile strength of at least about 250 kg/mm$^2$ and a modulus of elasticity of at least about 20 ton/mm$^2$, and contains about 3 to about 8% by weight of nitrogen based on the weight of the fiber.

During the step of carbonization wherein an acrylic fiber is carbonized, i.e., an organic fiber is converted to an inorganic fiber, the fiber weight inevitably decreases and thus, the amount of the metal impurities relative to the fiber weight increases.

The carbon fiber produced by the process of the present invention exhibits an oxidation resistance of a magnitude approximately equal to that of a graphite fiber and is far superior to a graphite fiber in tensile strength and adhesive properties for composite matrixes such as resins and carbon. Therefore, the carbon fiber so produced is useful in applications where high tensile strength and good adhesive properties are required, as well as applications where graphite fibers are used. For example, the carbon fiber is used in aircraft, automobiles and their engine parts.

The invention will be further illustrated with reference to the following examples wherein percent is by weight unless other wise specified.

In the examples, oxidation resistance, tensile strength, Young's modulus and adhesive properties of the carbon fibers were determined as follows.

Oxidation resistance 1.6 g of the carbon fiber were reeled up in the form of a ring and the reeled up specimen was weighed exactly. The specimen was placed in a 50 ml glass beaker and the beaker was left to stand in a hot-air dryer maintained at 315° C., for a period of 300 hours. The beaker was taken out from the dryer and the specimen was cooled to room temperature, and then, the specimen was again weighed exactly. The oxidation resistance was expressed in terms of the oxidative weight reduction calculated by the equation:

Oxidative weight reduction $\% = (W_1 - W_2)/W_1 \times 100$ where $W_1$ and $W_2$ are the weights of the specimen measured before and after the specimen was left to stand in the dryer.

Tensile strength and Young's modulus

A single carbon fiber specimen was gripped between clamps at grip distance of 20 mm. The specimen was drawn at a grip separation rate of 0.5 mm/min. and the breaking load was measured. Young's modulus was determined from the stress-strain curve.

In the determination of the tensile strength and Young's modulus, when the degree of variability in denier between single fibers in the yarn is relatively small, the cross-sectional area of each single fiber may be calculated from the weight per unit length of the yarn, the specific gravity and the number of filaments in the yarn. In contrast, when the degree of variability in denier between single fibers in the yarn is relatively large, the cross-sectional area of each single fiber may conveniently be calculated by a vibration method from the natural frequency of a single fiber specimen used for the tensile test. Furthermore, the waveness of a single fiber specimen and the elongation of the tester element, particularly the load cell, should be suitably corrected.

Adhesion to epoxy resin

Carbon fibers were impregnated with a liquid epoxy resin (a mixture of 100 parts of Epikote 828 supplied by Shell Chemical Co. and 5 parts of boron trifluoride monoethylamine). The resin-impregnated carbon fibers were placed in a laminar form in a mold and then maintained at a temperature of 40° C. for two hours under vacuum. Thereafter, the fibers were pressed at a pressure of 3 kg/cm$^2$ and then, maintained at a temperature of 170° C. under that pressure for a period of three hours, whereby a carbon fiber-reinforced epoxy resin composite flat plate containing approximately 72% by weight of the carbon fibers was obtained. A specimen of 18 mm length, 6 mm width and 2.5 mm thickness was cut from the composite flat plate. A three-point bending test was conducted on the specimen by using an autograph IS-2000 supplied by Shimazu Manufacturing Co., at a span distance of 8 mm and a cross-head speed of 2.5 mm/min., thereby measuring the breaking strength. The adhesion to epoxy resin was expressed in terms of interlaminar shear strength calculated from the breaking strength.

EXAMPLE 1

98.5 mole % of acrylonitrile, 0.5 mole % of itaconic acid and 1.0 mole % of methyl methacrylate were copolymerized in a solution state in dimethylsulfoxide containing 0.0001% by weight of the hereinbefore mentioned metal impurities by using azobisisobutyronitrile as a catalyst to obtain a copolymer solution. An equivalent amount, based on the units of itaconci acid in the copolymer, of ammonia was incorporated in the copolymer solution. The copolymer solution was stirred and then, extruded at 30° C. into an aqueous 50% dimethylsulfoxide solution containing 0.0001% by weight of the hereinbefore mentioned metal impurities. The filaments so formed were drawn at 80° C. to three times their original length in an aqueous 10% dimethylsulfoxide solution containing 0.0001% by weight of the hereinbefore mentioned metal impurities, and again drawn at 98° C. two times the drawn length in an aqueous 2% dimethylsulfoxide solution containing 0.0001% by weight of the hereinbefore mentioned metal impurities. The drawn filaments were brought into contact with a stream of water at 60° C. containing 0.0001% by weight of the hereinbefore mentioned metal impurities, thereby to be washed. Then, the washed filaments were subjected to an oil treatment by immersing the filaments at room temperature in an aqueous 3% solution containing about 0.005% by weight of the hereinbefore mentioned metal impurities. The treated filaments were then air-dried at 130° C. for 20 minutes, thereby to be consolidated. The filaments were further subjected drawing in steam to obtain filaments of 3,000 total deniers (one denier per filament). The total drawing ratio was 8:1. These filaments were desirably dense and had a dry tensile strength of about 5.5 g/denier and a dry elongation of about 15%. The filaments contained about 0.01% of metal impurities (Na:0.001%, K:0.001%, Ca:0.004%, Fe:0.003% and other metals:0.001%).

The filaments were heated at 240° C. for two hours in air thereby to be oxidized, and then, the oxidized filaments were heated to 1,200° C. in a nitrogen atmosphere to obtain carbon filaments. The carbon filaments had a tensile strength of 280 kg/mm$^2$, a modulus of elasticity of 2.20 ton/mm$^2$ and a specific volume resistance of about $2.2 \times 10^{-3}$ ohm.cm and contained about 7.1% of nitrogen. The carbon filaments contained about 0.016% of metal impurities (Na:0.0015%, K:0.0015%, Ca:0.0065%, Fe:0.0045% and others:0.002%).

When the carbon filaments were maintained at 315° C. in air for 300 hours, the weight loss was only about 8%.

COMPARATIVE EXAMPLE 1

A spinning dope similar to that mentioned in Example 1 was spun into filaments, and the filaments were drawn, washed with water, drawn, oil-treated, air-dried, and then again drawn, in a manner similar to that in Example 1, wherein soft water containing about 0.003% of metals was used instead of the deionized water. The acrylonitrile copolymer filaments (1 denier $\times$ 3,000) so obtained had a dry tensile strength of about 5.5 g/denier and a dry elongation of about 15%, and contained about 0.22% of metal impurities (Na:0.212% and others:0.011%).

Carbon filaments were manufactured from the acrylonitrile copolymer filaments in a manner similar to that mentioned in Example 1. The carbon filaments had a tensile strength of 290 kg/mm$^2$, a modulus of elasticity of 22.0 ton/mm$^2$ and a specific volume resistance of about $2.2\times10^{-3}$ ohm.cm, and contained about 6.5% of nitrogen. The carbon filaments contained about 0.328% of metal impurities.

The carbon filaments exhibited about a 15% weight loss upon heating as tested in a manner similar to that in Example 1.

EXAMPLE 2

98.5 mole % of acrylonitrile, 0.5 mole % of itaconic acid and 1.0 mole % of methyl methacrylate were copolymerized in a solution state in dimethylsulfoxide containing 0.0001% by weight of the hereinbefore mentioned metal impurities by using azobisisobutyronitrile as a catalyst to obtain a copolymer solution. The copolymer solution was divided into four parts. 1/10, 1/5, ½ and 1 equivalent amounts, based on the units of itaconic acid in the copolymer, of ammonia were separately incorporated in the respective parts. Each part was mixed by stirring to prepare a spinning dope. The spinning dope was extruded at 30° C. into an aqueous 50% dimethylsulfoxide solution containing 0.0001% by weight of the hereinbefore mentioned metal impurities. The filaments so formed were drawn to three times their original length in an aqueous 10% dimethylsulfoxide solution at 80° C., and again drawn two times the drawn length in an aqueous 2% dimethylsulfoxide solution at 98° C. The drawn filaments were washed with a stream of water and, then, subjected to an oil treatment, in the same manner as mentioned in Example 1. The filaments were air-dried at 130° C. for 20 minutes, thereby to be consolidated. The cross-sectional area of each filament was measured before and after the air-drying consolidating treatment. The consolidating ratio was calculated from the following equation.

$$\text{Consolidating ratio} = A/B$$

where

A = cross-sectional area before consolidation

B = cross-sectional area after consolidation

Results are shown in Table I, below.

TABLE I

| Run No. | Amount of ammonia (equivalent) | $NH_4^+$ substituted itaconic acid content (mole %) | Consolidating ratio |
|---|---|---|---|
| 1 | $\frac{1}{10}$ | 0.05 | 1.3 |
| (comparative) | | | |

TABLE I-continued

| Run No. | Amount of ammonia (equivalent) | $NH_4^+$ substituted itaconic acid content (mole %) | Consolidating ratio |
|---|---|---|---|
| 2 | $\frac{1}{5}$ | 0.1 | 2.9 |
| 3 | ½ | 0.25 | 3.4 |
| 4 | 1 | 0.5 | 3.6 |

As is seen from Table I, the desired consolidated fiber is obtained when the itaconic acid units having ammonium carboxylate groups are present in an amount of at least about 0.1 mole % in the copolymer.

The respective filaments were further drawn in steam so that the total drawing ratio was 8.0/1. The filaments of Run No. 1, which were consolidated only to a minor extent, exhibited a strength of 2.0 g/denier. The other filaments exhibited higher strengths (No. 2: 4.5 g/denier, No. 3: 5.5 g/denier, and No. 4: 5.5 g/denier).

The respective filaments were oxidized and then carbonized in the same manner as mentioned in Example 1. The carbon filaments, so obtained, had strengths as follows:

Run No. 1, 160 kg/mm$^2$;

Run No. 2, 250 kg/mm$^2$;

Run No. 3, 290 kg/mm$^2$; and

Run No. 4, 280 kg/mm$^2$).

EXAMPLE 3

Precursor filaments containing about 0.01% of metal impurities were prepared in the same manner as mentioned in Example 1. The precursor filaments were heated at 240° C. in air for two hours thereby to be oxidized, and then, the oxidized filaments were carbonized and graphatized in a nitrogen atmosphere at various temperatures shown in Table II, below. Properties of the resulting filaments are shown in Table II, below.

TABLE II

| Carbonization temperature (°C.) | Specific volume resistance (ohm.cm) | Content of nitrogen (%) | Content of metal impurities (%) | Oxidative weight reduction (%) | Adhesion to epoxy resin (Kg/mm$^2$) | Strength (Kg/mm$^2$) |
|---|---|---|---|---|---|---|
| 1000 | $3\times10^{-2}$ | 16.1 | 0.014 | 21 | 8.5 | 210 |
| 1200 | $2.2\times10^{-3}$ | 7.1 | 0.016 | 8.0 | 9.3 | 280 |
| 1400 | $1.5\times10^{-3}$ | 4.2 | 0.013 | 3.1 | 9.1 | 310 |
| 1600 | $1.2\times10^{-3}$ | 2.0 | 0.009 | 1.5 | 6.2 | 250 |
| 2000 | $1.0\times10^{-3}$ | 0.1 | 0.004 | 0.9 | 3.4 | 190 |

EXAMPLE 4

Precursor filaments were prepared in the same manner as mentioned in Example 1, wherein the following oiling agents were used with all other conditions remaining substantially the same.

Run No. 1: purified lauryl alcohol ethylene oxide addition product containing 0.005% of metal impurities, Run No. 2: non-purified lauryl alcohol ethylene oxide addition product containing 0.45% of metal impurities, and Run No. 3: lauryl phosphate potassium salt.

The precursor filaments were heated at 240° C. in air for two hours thereby to be oxidized, and then, the oxidized filaments were heated at 1400° C. in a nitrogen atmosphere thereby to be carbonized.

The content of metal impurities in the resulting carbon filaments and the oxidative weight reduction thereby are shown in Table III, below.

TABLE III

| Run No. | Oiling agent | Content of metal impurities (%) | Oxidative weight reduction (%) |
|---|---|---|---|
| 1 | purified lauryl alcohol ethylene oxide addition product | 0.013 | 3.1 |
| 2 | non-purified lauryl alcohol ethylene oxide addition product | 0.094 | 11 |
| 3 | lauryl phosphate potassium salt | 0.51 | 13 |

EXAMPLE 5

98.1 mol% of acrylonitrile, 0.4 mol% of itaconic acid and 1.5 mole% of methyl methacrylate were copolymerized in a solution state in dimethyl sulfoxide by using azobisisobutyronitrile as the catalyst to obtain a copolymer solution. The dimethyl sulfoxide used contained approximately 0.10% by weight of metal impurities (mainly comprised of sodium). The copolymer solution so obtained is herein referred to as copolymer solution "C".

The above-mentioned procedure of copolymerization was repeated wherein highly purified dimethyl sulfoxide containing less than 0.00005% by weight of metal impurities was used as the polymerization solvent with all other conditions remaining substantially the same. The copolymer solution so obtained is herein referred to as copolymer solution "D".

As equivalent amount, based on the units of itaconic acid in the copolymer, of ammonia is incorporated into each of the copolymer solution C and D. The respective ammonia-incorporated copolymer solutions were separately well stirred to prepare spinning dopes C and D. Each of the spinning dopes C and D was divided into two parts.

One part was extruded into an aqueous 50% dimethyl sulfoxide solution at a temperature of 30° C. The dimethyl sulfoxide used was highly purified and contained less than 0.00005% by weight of metal ingredients, and the water used was deionized water containing 0.0001% by weight of metal ingredients. The filaments so formed were drawn to three times their original length in an aqueous 10% dimethyl sulfoxide solution at a temperature of 80° C., and again drawn two times the drawn length in an aqueous 2% dimethyl sulfoxide solution at a temperature of 98° C. The dimethyl sulfoxide and water used for the preparation of the two drawing baths were similar to those used for the preparation of the coagulation bath. The drawn filaments were washed with deionized water at a temperature of 50° C. and, thereafter, passed through an approximately 3% solution of a lauryl alcohol-ethylene oxide addition product in deionized water at room temperature. The lauryl alcohol-ethylene oxide addition product used was purified and contained 0.005% by weight of metal ingredients (mainly comprised of potassium): Thereafter, the filaments were air-dried at a temperature of 130° C. for approximately 20 minutes, thereby to be consolidated. The resulting filaments from the spinning dopes C and D are herein referred to as filaments C-1 and D-1, respectively.

The other part of the spinning dopes C and D was also similarly spun into filaments, and the filaments were similarly drawn, washed with water, treated with an aqueous solution of a lauryl alcohol-ethylene oxide addition product, and finally air-dried, wherein soft water containing 0.003% by weight of metal ingredients (mainly comprised of sodium) was used instead of the deionized water used for the preparation of the coagulation bath, the drawing bath and the aqueous oiling bath, and for the filament washing. The resulting filaments from the spinning dopes C and D are herein referred to as filaments C-2 and D-2, respectively.

The respective filaments were heated at a temperature of 240° C. for 2.5 hours in air thereby to be oxidized, and then, the oxidized filaments were heated to a temperature of 1300° C. in a nitrogen atmosphere to obtain carbon filaments.

The content of the impurities in the respective acrylonitrile copolymer filaments C-1, C-2, D-1 and D-2 and in the respective carbon filaments resulting from the acrylonitrile copolymer filaments was as shown in Table IV, below.

When the carbon filaments were maintained at 315° C. in air for 300 hours, the resulting filaments exhibited oxidative weight reductions as shown in Table IV, below.

TABLE IV

| Specimen | DMSO | Water | Metal impurity content in AN copolymer filaments (%) | Metal impurity content in carbon filaments (%) | Oxidative weight reduction (%) |
|---|---|---|---|---|---|
| D-1 | Purified | Purified | 0.01 | 0.018 | 5.7 |
| D-2 | Purified | Soft | 0.18 | 0.26 | 13 |
| C-1 | Unpurified | Purified | 0.34 | 0.57 | 14 |
| C-2 | Unpurified | Soft | 0.35 | 0.58 | 13 |

EXAMPLE 6

Precursor acrylic filaments were prepared in the same manner as mentioned in Example 1, wherein the filaments, after being washed with water but before being dried for consolidation, were immersed for one minute in an aqueous metal salt solution, maintained at 60° C., which solution contained 0.1% of the metal ion and was prepared from the metal salts shown in Table V, below, and purified water containing 0.0001% of the hereinbefore mentioned metal impurities. All other conditions remained substantially the same. The resulting precursor filaments were proved by the ion exchange reaction to contain the respective metals corresponding to the metal salts shown in Table V, below.

The filaments were oxidized and then carbonized in a manner similar to that mentioned in Example 1. The carbon filaments, so obtained, exhibited the metal impurity contents, the oxidative weight reductions and the adhesions to epoxy resin, which are shown in Table V, below. For a comparison purpose, the properties of the carbon filaments obtained in Example 1 are also shown in Table V, below.

TABLE V

| Run No. | Metal salt used | Metal impurity content (%) | Oxidative weight reduction (%) | Adhesion to epoxy resin ($Kg/mm^2$) |
|---|---|---|---|---|
| 1 | $Na(CH_3COO)$ | 0.13 | 14 | 7.1 |
| 2 | $K(CH_3COO)$ | 0.14 | 17 | 7.3 |
| 3 | $Mn(CH_3COO)_2$ | 0.11 | 25 | 7.5 |
| 4 | $Fe(CH_3COO)_2$ | 0.13 | 18 | 6.8 |
| 5 | $Cu(CH_3COO)_2$ | 0.11 | 14 | 8.2 |
| 6 | $Ni(CH_3COO)_2$ | 0.10 | 17 | 7.5 |
| 7 | $Co(CH_3COO)_2$ | 0.11 | 17 | 8.4 |
| 8 | $Cr(CH_3COO)_2$ | 0.13 | 19 | 7.9 |
| 9 | $Ca(CH_3COO)_2$ | 0.13 | 9.1 | 7.8 |
| 10 | $Zn(CH_3COO)_2$ | 0.10 | 7.9 | 6.9 |
| 11 | $Pb(CH_3COO)_2$ | 0.096 | 8.3 | 8.0 |
| 12 | $Sn(CH_3COO)_2$ | 0.081 | 7.5 | 7.7 |
| 13 | $Hg(CH_3COO)_2$ | 0.092 | 8.1 | 7.2 |
| | Example 1 | 0.016 | 8.0 | 9.3 |

EXAMPLE 7

A monomer mixture comprised of 99.1 mole% of acrylonitrile, 0.5 mole% of itaconic acid and 0.4 mole% of ammonium allylsulfonate was polymerized in a manner similar to that mentioned in Example 1. Precursor filaments were prepared from the copolymer solution so formed in a manner similar to that mentioned in Example 1. The precursor filaments were oxidized and then carbonized in a manner similar to that mentioned in Example 1.

The carbon filaments contained 0.018% of metal impurities and 0.135% of a sulfur impurity. The oxidative weight reduction and the adhesion to epoxy resin, of the carbon filaments are shown in Table VI, below. For a comparison purpose, the properties of the carbon filaments obtained in Example 1 are also shown in Table VI, below.

TABLE VI

| | Metal impurity content (%) | Sulfur impurity content (%) | Oxidative weight reduction (%) | Adhesion to epoxy resin ($Kg/mm^2$) |
|---|---|---|---|---|
| Example 7 | 0.018 | 0.135 | 8.9 | 7.4 |
| Example 1 | 0.016 | 0.013 | 8.0 | 9.3 |

EXAMPLE 8

The carbon filaments obtained in Example 1 were divided into three parts. The respective parts were separately immersed in aqueous 5% hydrochloric acid, hydroiodic acid and hydrobromic acid solutions for 24 hours. Then, the filaments were dried in air at 50° C. The halogen content, the oxidative weight reduction and the adhesion to epoxy resin, of the filaments are shown in Table VII, below.

TABLE VII

| Acid used | Halogen content (%) | Oxidative weight reduction (%) | Adhesion to epoxy resin ($Kg/mm^2$) |
|---|---|---|---|
| hydrochloride acid | 0.9 | 7.5 | 7.1 |
| hydroiodic acid | 0.7 | 8.7 | 5.7 |
| hydrobromic acid | 1.2 | 6.9 | 6.3 |
| Example 1 | 0.0 | 8.0 | 9.3 |

COMPARATIVE EXAMPLE 2

An ammonia-incorporated copolymer solution similar to that mentioned in Example 1 was stirred and, then, added drop by drop into deionized water containing 0.0001% of metal impurities whereby the copolymer was coagulated. The coagulated copolymer was washed with water thereby to remove dimethylsulfoxide therefrom, and then, dried under a vacuum at 110° C. for five hours. The dried solid copolymer was dissolved in an aqueous sodium thiocyanate solution of a 50% concentration to prepare a spinning solution of an approximately 15% concentration. The spinning solution was extruded into a coagulating bath consisting of an aqueous 12% solution of sodium thiocyanate, which solution was maintained at −3° C. and had a pH of 4 which was adjusted by adding sulfuric acid thereto. The gel filaments, so obtained, were completely washed with a stream of water, and then, drawn four times their original length in a water bath maintained at 98° C. Thereafter, the drawn filaments were oil-treated, dried thereby to be consolidated, and then, drawn two times their original length in steam, in a manner similar to that mentioned in Example 1. The obtained precursor filaments were oxidized and then carbonized in a manner similar to that mentioned in Example 1. The resultant carbon filaments contained 0.39% of metal impurities (mainly comprised of sodium) and exhibited an oxidative weight reduction of 17%. Obviously, these carbon filaments are inferior to those produced by the process of the invention.

What we claim is:

1. An improvement in a process for producing a carbon fiber of enhanced oxidation resistance, having a specific volume resistance of at least about $1.2\times10^{-3}$ ohm.cm, and containing, based on the weight of the carbon fiber, at least about 2% by weight of nitrogen and less than about 0.03% by weight of total impurities consisting of Na, K, Fe, Cu, Ni, Co, Cr, Mn and S, wherein a precursor acrylic polymer fiber is heated at a temperature of from about 200° to about 350° C. in an oxidizing atmosphere, thereby to be oxidized, and then, the oxidized fiber is heated to a temperature of from about 700° to about 1,600° C. in a non-oxidizing atmosphere, thereby to be carbonized;

said improvement comprising using as the precursor fiber an acrylonitrile copolymer fiber, which copolymer is comprised of at least 95% by mole of units derived from acrylonitrile and not more than 5% by mole of units derived from a carboxyl group-containing copolymerizable monoethylenically unsaturated monomer or monomers; the hydrogen atom of at least one carboxyl group contained in each of the units derived from the carboxyl group-containing monomer or monomers being replaced with a cation selected from the group consisting of:

$$R-\overset{R}{\underset{R}{N}}{}^{\oplus}-R \quad \text{and} \quad RNHN^{\oplus}H_3,$$

wherein R is selected from a hydrogen atom, alkyl groups having 1 to 3 carbon atoms and a phenyl group; said replacement being to such an extent that the units having the introduced cation occupy from 0.1% to 5% by mole, based on the copolymer, and, which copolymer contains less than about 0.05% by weight, based on the weight of the copolymer, of total impurities consisting of Na, K, Fe, Cu, Ni, Co, Cr, Mn and S; and said acrylonitrile copolymer fiber being produced by the steps of:

preparing a spinning dope of the acrylonitrile copolymer in an organic solvent, and;

extruding the spinning dope into an aqueous coagulating bath to form a fiber, followed by treating the fiber by using an aqueous drawing bath, an aqueous washing bath and an aqueous oiling bath, all of the aqueous baths being prepared from water selected from deionized water and distilled water, and the aqueous oiling bath being prepared by using a cationic or nonionic oiling agent; each of the spinning dope, the aqueous coagulating bath, the aqueous drawing bath and the aqueous washing bath containing not more than 0.0005% by weight, based on the weight of the respective dope or bath, of total metal impurities consisting of Na, K, Fe, Cu, Ni, Co, Cr and Mn, and the aqueous oiling bath containing not more than 0.1% by weight, based on the weight of the aqueous oiling bath, of total impurities consisting of Na, K, Fe, Cu, Ni, Co, Cr, Mn and S.

2. A process according to claim 1 wherein said carbon fiber has a specific volume resistance of from about $1.3\times10^{-3}$ ohm·cm to about $2.2\times10^{-3}$ ohm·cm, and contains from about 3% to 8% by weight of nitrogen, based on the weight of the carbon fiber; and said oxidized fiber is heated to a temperature of from about 1,200° to 1,500° C.

* * * * *